US005291634A

United States Patent [19]

Zanetti

[11] Patent Number: 5,291,634

[45] Date of Patent: Mar. 8, 1994

[54] A HINGE FOR THE CONSTRAINING OF HATCHES OR DOORS FROM A SUPPORT STRUCTURE

[75] Inventor: Augusto Zanetti, Bologna, Italy

[73] Assignee: Nuova Star S.r.l., Bologna, Italy

[21] Appl. No.: 923,255

[22] Filed: Jul. 30, 1992

[30] Foreign Application Priority Data

Mar. 26, 1992 [IT] Italy ..... B092A 000110

[51] Int. Cl.[5] ..... E05D 11/10

[52] U.S. Cl. ..... 16/333; 16/334

[58] Field of Search ..... 16/333, 334, 344, 347, 16/65, 80

[56] References Cited

U.S. PATENT DOCUMENTS

| | | | |
|---|---|---|---|
| 2,483,947 | 10/1949 | Turner | 16/65 |
| 2,769,197 | 11/1956 | Travis et al. | 16/65 |
| 2,823,661 | 2/1958 | Grannan | 16/80 |
| 4,833,755 | 5/1989 | Bonin | 16/347 |

*Primary Examiner*—John Sipos

*Assistant Examiner*—Carmine Cuda

*Attorney, Agent, or Firm*—Darby & Darby

[57] ABSTRACT

The invention relates to a hinge for the constraining of a hatch or door from a support structure. The hinge is of the type constituted by a first part constrainable from the support structure and by a second part constrainable from the closing door of the support structure itself. The second part is pivoted about respective parallel axes arranged near the lower edge of the door. A lower arm is rigidly and movably connectable to a lower portion of the first part. The lever has an upper edge slidably in contact with an idler wheel supported by an upper portion of the first part. The lever exhibits a first substantially straight tract, a second curved tract with at least one center of curvature arranged above the lever, and a third tract, also curved with at least one center of curvature arranged above the lever and connected to the second tract by an arched projection with at least one center of curvature arranged below the lever.

5 Claims, 2 Drawing Sheets

A HINGE FOR THE CONSTRAINING OF HATCHES OR DOORS FROM A SUPPORT STRUCTURE

BACKGROUND OF THE INVENTION

The invention relates to a hinge for constraining doors or hatches from a support structure.

In particular, the present invention relates to a hinge advantageously usable to constrain oven doors from ovens.

Conventional hinges are usually constituted by a box structure associated with the door, a lever pivoted at one of its ends internally to the box structure and associated with its other end to a support structure and a rod movable longitudinally internally of the box structures. One of the rod's ends is at an intermediate point of the lever and subjected to the action of elastic means anchored to the box structure.

The elastic means, whether of a traction type or a compression type, maintain the lever in one of at least two stable configurations; one configuration corresponds to the open-door situation and the other to the closed-door situation.

The lever emerges from the box structure through a respective longitudinal slot by means of its end which is to be associated with the support structure. Usually, for technical reasons connected with greater functionality, the lever is arranged in proximity to an end of the box structure and the extreme transversal edges of the slot act as end-run stops for the lever. In particular, the longitudinal wall of the box structure having the slot acts as an end-run stop for the lever in its closed-door configuration. The near transversal wall, which usually defines the slot, acts as end-run stop for the lever in its open-door configuration. Frequently the open door is used as a leaning surface for the dishes taken out of the oven, for example for checking the progress of the food being cooked. Considering that the temperature of the oven is usually rather high, instinctively the dish will be placed in proximity with the extreme edge of the door itself so that the user will feel less of the intense heat of the oven. Distancing the dish from the support structure, however, means increasing the moment of the weight that the dish exerts on the door, and ultimately, on the door support coinciding with the hinges.

When the door is in its open position, the hinge is kept in the corresponding configuration only by the transversal wall of the box structure on which the lever exerts a flexing force.

At present, the hinge box structure is obtained by means of bending or pressing of a rather thick steel sheet. Consequently, the transversal wall is made from the same sheet which is not mechanically resistant enough to flexion to ensure a sufficient degree of safety with regard to the flexing load.

On the other hand, the existing safety norms envisage that, when the door is in its extreme open position and a load is placed on it, the hinge must stand a load which is normally superior to the maximum flexion resistance of the transversal wall structured in the above-mentioned manner.

The simplest solution would seem to be that of strengthening the wall or making the box structure by casting, but that would be too expensive for the manufacturing companies as well as for the ultimate buyer.

Furthermore, the same hinges must be, in their open-door configuration, not only able to support a determined weight, but also sure to give way, more or less, when weights of an unforeseen but excessive (with respect to the predetermined maximum admissible weight) entity suddenly load on to the door.

With the aim of eliminating the possibility of this dangerous situation occurring, it has been proposed that there should be introduced, in the kinematic mechanism of the hinge, a weakening element with a predetermined breaking load, so that a load greater than the said breaking load would cause a giving of the weakening element itself and a consequent free rotation of the door, avoiding thus the toppling of the whole structure. Obviously, however, such a solution would bring about, in the case of such a breaking of the weakening element, the necessity of repairing the hinge through the substitution of the weakening element itself, with a consequent temporary withdrawal of the oven from use, and incurring considerable costs.

SUMMARY OF THE INVENTION

The objective of the present invention is to provide a hinge of the above-mentioned type, able to withstand considerable but prudently limited loads bearing on the open door, but which, at the same time, is economical and easy to make and mount, and avoids the dangerous situations described previously with reference to the conventional hinges.

The invention solves the problem of providing a hinge for the constraining of hatches or doors from a support structure by a first part constrainable to the support structure, and by a second part constrainable to the closing door of the support structure itself. The second part is pivoted, about respective parallel axes arranged near to the lower edge of the door, one end of a lower arm and the substantially coplanar pivot of an upper lever. The arm is rigidly and movably connected to a lower portion of the first part. The upper lever has an upper edge slidably in contact with an idler wheel supported by an upper portion of the first part. The arm and the lever are reciprocally movable during the movement of the second part with respect to the first part between a closed and an open door configuration, between a configuration of reciprocal maximum distancing and one of maximum nearness. Elastic means are interpositioned between the second part and the lever and act between them. The upper edge of the lever exhibits, starting from at least its point of contact with the idler wheel corresponding to the total closed configuration of the door, a first substantially straight tract, a second curved tract with at least one center of curvature arranged above the lever, and a third tract, also curved with at least one center of curvature arranged above the lever. The tracts connect to compose the upper edge without gaps.

According to a preferred embodiment of the present invention, the hinge comprises a box structure for the movable housing of the second part, at least one seating being envisaged in a lower zone of the door for the receiving of a box structure and fixing means of the box structure to the door being envisaged, inserted into the housing.

Further, preferably the lever is equipped, inferiorly and in proximity to its fulcrum, with an appendix projecting substantially downwards. The box structure has a housing to receive the appendix itself when the idler wheel is in contact with the third tract. The entrance of the appendix into the housing determines the substantial immovability of the second part with respect to the box structure.

BRIEF DESCRIPTION OF THE DRAWINGS

The advantages and characteristics of the present invention will be better understood from the detailed description that follows, with reference to the accompanying drawings, which describes an embodiment which is purely in the form of a non-limiting example, and in which.

DESCRIPTION OF THE PREFERRED EMBODIMENTS

Figure 1:
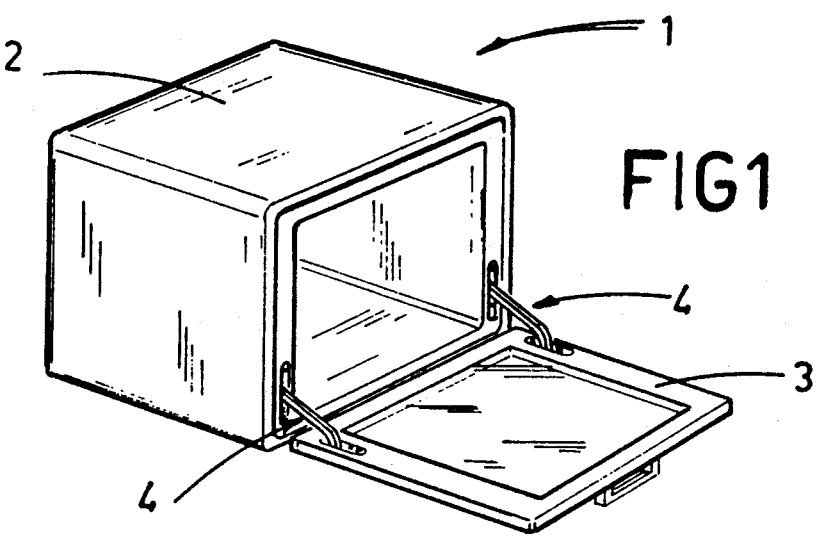
FIG. 1 shows a perspective view of an oven equipped with a door anchored to it by means of two hinges in accordance with the present invention.

In FIG. 1, an oven 1 comprises a box structure 2 whose frontal zone is inferiorly connected to a door 3 by means of two hinges 4 which allow the door 3 to rotate about a horizontal axis. The box structure 2 constitutes a support structure of the door 3, and the fact that the box structure 2 itself is here considered to be part of an oven should not be seen as a limitation to its applicative possibilities, since the structure could be of any kind. In the description which follows, however, the hinges 4 will be considered for simplicity's sake usable in relation to an oven.

Figure 2:
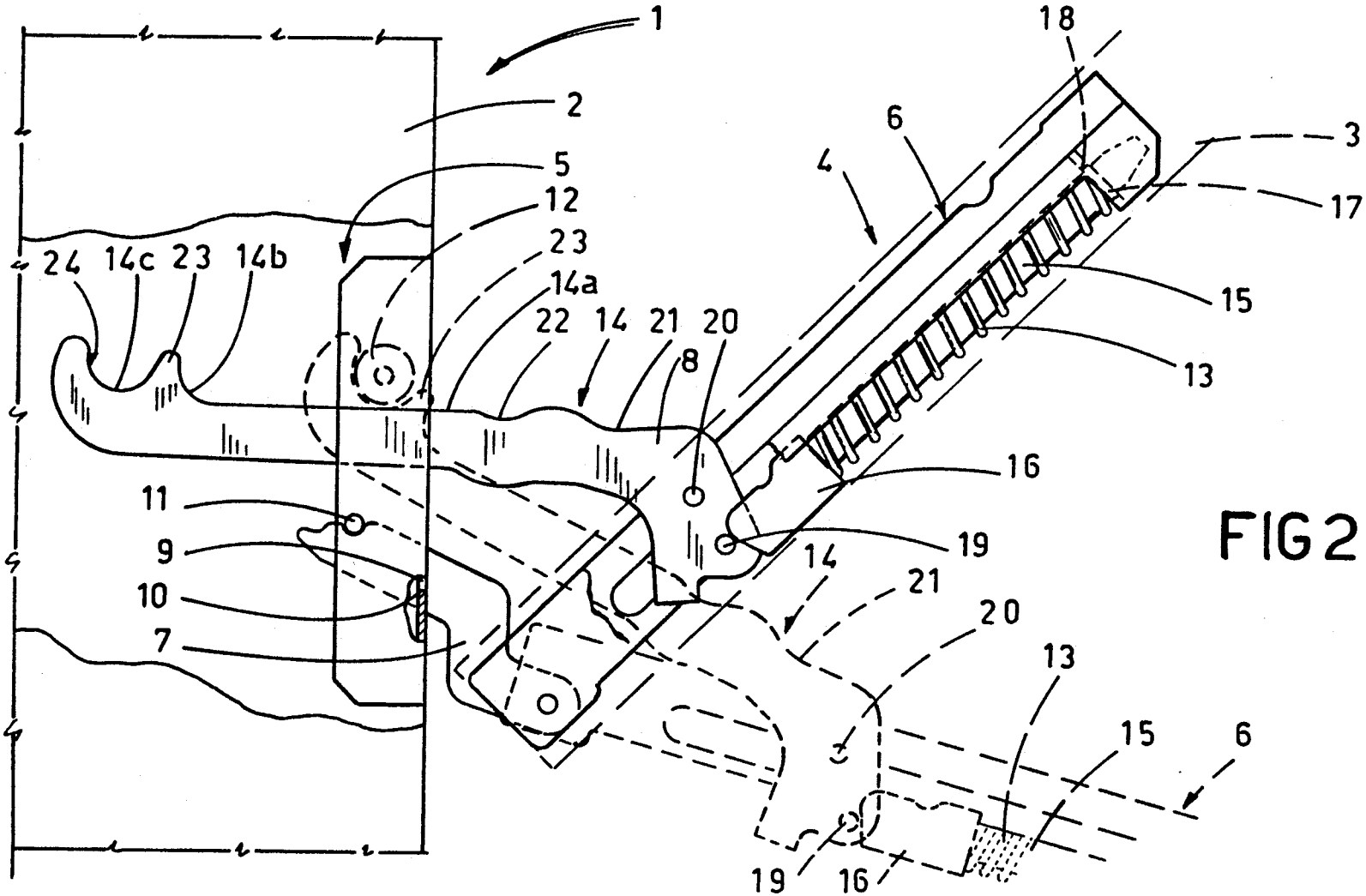
FIG. 2 shows a schematic front view, partially in section, or one of the hinges of FIG. 1 in two different operative conditions.

According to the drawing, in particular, in FIG. 2 and according to what has been previously indicated, the hinges 4 are positioned in proximity to the lower edge of the door 3, so that the door 3 is opened and closed tiltingly. Each hinge 4 comprises essentially two parts constituted by two extended box structures 5 and 6 associable, with a vertical disposition when the door 3 is closed, to the box structure 2 and respectively to the door 3 itself. To the extended box structure are pivoted an arm 7 inferiorly and a lever 8 superiorly vertically substantially coplanar. The arm 7 and the lever 8 are pivoted to the extended box structure 6 with possibility of rotation about axes which are parallel between themselves. The arm 7 is rigidly but movably constrained from the box structure 5 at the lower end of a longitudinal slot 9 made in the box structure 5. For example, the arm 7 exhibits an inferior nick 10 destined to rest on the lower edge of the longitudinal slot 9, and the box structure 5 has a small crossbar 11 to prevent an upwards rotation of the arm 7 introduced into the longitudinal slot 9 and already arranged with its inferior nick 10 resting on the lower edge of the longitudinal slot 9.

The lever 8 is inserted into the longitudinal slot 9 above the arm 7 and has its upper edge constantly in contact with an idler wheel 12 having its axis normal to the plane of the figure. The lever 8 is arranged in the box structure 5 and operates at the upper end of the longitudinal slot. Also, elastic means 13 act on the lever 8, which elastic means 13 keep the edge 14 of the lever 8 in contact with the idler wheel 12. The lever 8 is generally a first class lever 8, and the elastic means 13 are constituted by a compression helix spring housed in the box structure 6 and interpositioned between the box structure 6 and the end of the lever 8 internal to the box structure 6 itself. More exactly, the elastic means or spring 13 is entirely fitted about a rod 15 whose lower end exhibits a widening 16 and whose upper end runs into a hole 17 bored in a plate 18 solid to an upper zone of the box structure 6 and arranged normal to a longitudinal axis of the box structure 6 itself. The widening 16 has substantially a fork shape placed on the respective end of the lever 8 and rests with its ends housed on the opposite ends of a pivot 19 crossing the lever 8 parallel to its pivot axis 20. The lever 8 operates as a first class lever and the spring 13 is thus compressed between the plate 18 on one side and the widening 16 on the other.

According to the present invention, the upper edge 14 of the lever 8 is subdivided essentially into three tracts 14*a*, 14*b* and 14*c*, consecutive and connecting without a gap. The first tract 14*a* is substantially straight, exhibiting, in proximity to the pivot axis 20 of the lever 8, two successive small arched recesses 21 and 22, upwardly concave. The second tract 14*b* has a rather large angle of curvature with the center of curvature arranged superiorly to the lever 8, and is delimited, by the band opposite to the pivot axis 20, by an upwardly arched projection 23 as in FIG. 2 which acts as a means of separation between the second tract 14*b* and the third tract 14*c*, which last is equipped with at least one center of curvature arranged below the lever 8 itself. The third tract 14*c* is defined by an arched recess 24 of the end portion of the lever 8 arranged at the maximum distance from the pivot axis 20 of the lever 8 itself, its concavity upwardly disposed. In other words, according to the figures, the upper edge 14 of the lever 8 exhibits, starting from at least its point of contact with the idler wheel 12 corresponding to the totally-closed configuration of the door 3, a first tract 14*a* which is substantially straight, a second tract 14*b* which is curved with at least one center of curvature arranged above the lever 8, and a third tract 14*c*, also curved with at least one center of curvature arranged above the lever 8, with the three tracts 14*a*, 14*b* and 14*c* connected without gaps.

Furthermore, the construction of the upper edge 14, together with the construction and the dimension of the arm 7 are such that when the idler wheel 12 is in contact with a point of the upper edge 14 which is well determined and substantially coincident with the arched recesses 21 and 22, the spring 13 assumes its maximum-extension configuration and the door 3 is substantially in its closed position.

When the idler wheel 12 is in contact with a point of the upper edge 14 which substantially coincides with the arched recess 22, the spring 13 is moderately compressed and the door 3 is in a stable partially open position, usable when, for example it is desired to use the oven to brown food on the top by means of radiation from heated electrical resistance elements.

The construction of the remaining portion of the first tract 14*a* is such that, as long as the idler wheel 12 is in contact with it, the moment exerted by the spring 13 on the door 3 is slightly lower than the movement exerted on the door 3 by the weight of the door 3 and the elements associated with it. In this way, a gradual and continuous descent of the door is guaranteed during the opening phase, up until the substantial overpositioning of the idler wheel 12 on the second tract 14*b*, which takes place when the door 3 reaches the normal maximum. opening situation. At this point, the spring 13 is strongly compressed and the arched projection 23 functions as a stop for the idler wheel 12, preventing, in normal manual movement conditions, a greater opening of the door 3 itself.

In the case in which, according to what was indicated in the premise to this description, there should bear upon the completely-open door 3 an excessive load superior to a predetermined maximum weight, the arched projection 23 would overcome the resistance of the spring 13 and would cross the idler wheel 12, causing the entrance of the idler wheel 12 into the arched recess 24 defining the third tract 14c (this situation is shown by the broken line in FIG. 2), with a consequent immediate further opening of the door 3 able to eliminate any tilting moment acting on the oven 1 thanks to the presence of the above-mentioned excess weight on the door 3.

Figure 4:
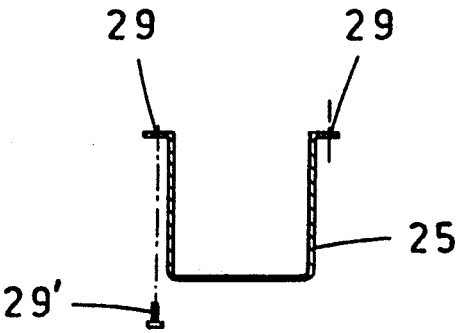
FIG. 4 shows a view in section, across line 4—4 of FIG. 3, of the accessory of FIG. 3.
Figure 3:
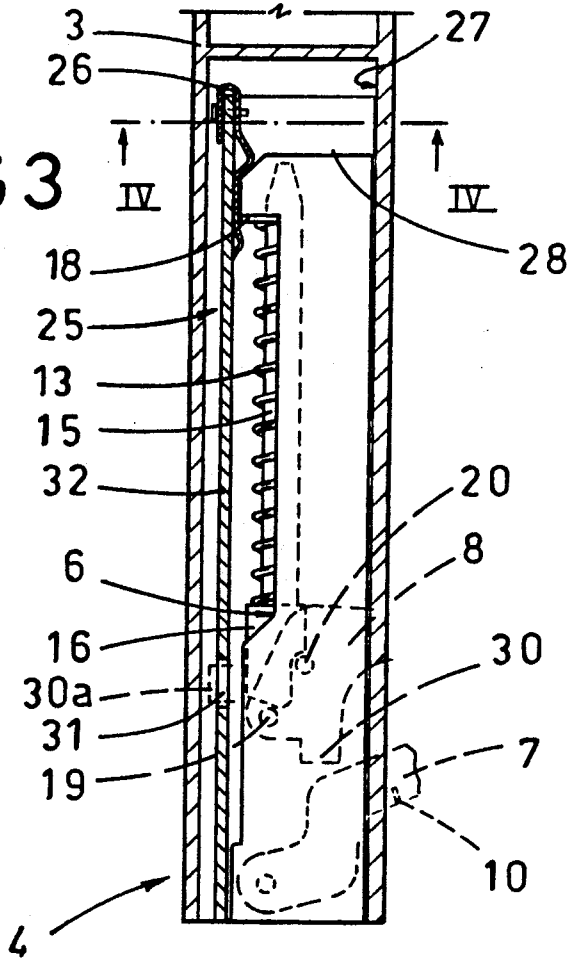
FIG. 3 shows a partially sectioned view of the hinge of FIG. 2 and of an accessory valid for use in its installation.

It should be noted that, according to what is illustrated especially in FIG. 3, for the connection of a hinge 4 to an oven 1 door 3, the box structure 6 is preferably housed, in the way illustrated in FIG. 3, inside a box structure 25 made in pressed sheet metal and exhibiting substantially in section a shape (FIG. 4). Once the insertion has been done, the box structure 6 is axially held inside the box structure 25 by means of a shaped clip 26 and the whole constituted by the box structure 25 and the box structure 6 can be easily inserted, by axial sliding, in a long housing 27 present inside the door 3. The box structure 25 can thus be anchored to a wall 28 of the door 3 by means of fixing means constituted preferably by screws 29 inserted in respective holes 29.

According to FIGS. 2 and 3, the end of the lever 8 near to the pivot axis of the lever 8 itself is provided with an appendix or tooth 30 which, when the lever 8, with door 3 closed, is arranged in the situation indicated by the broken line in FIG. 3, is downwards projecting and entirely contained within the box structure 6. In the case in which, according to what has been previously mentioned, the oven 1 door 3 is subjected to excess weight and the idler wheel 12 enters into the arched recess 24, the tooth 30 is disposed in the way illustrated with the unbroken line in FIG. 3, denoted by number 30a, and is inserted into a longitudinal slot or seating 31 made in a wall 32 of the box structure 25. This prevents, after having reached and pushed against an edge of the seating 31 itself, the hinges 4, under the pressure of the heavy load that pushed the door 3 downwards and tends also to distance it from the oven 1, from detaching from the box structure 25 and thus determining the detaching of the door 3 from the oven 1.

As described, each hinge 4 fully achieves the desired objection being both economical and of easy construction, and is perfectly capable of sustaining considerable but carefully limited loads on its open door 3. Further, the hinges 4 described avoid the described dangerous situations without presenting the drawbacks described with reference to conventional hinges.

What is claimed:

1. A hinge useful in constraining a hatch or door from a support structure, comprising a first part constrainable from the support structure, a second part constrainable from the hatch or door, a lower arm and an upper lever each with a respective end pivoted substantially coplanar to said second part about respective parallel axes that are closer to a lower edge of the hatch or door than to an upper edge of the hatch or door, said arm being rigidly and movably connectable to a lower portion of said first part, said upper lever having an upper edge slidably in contact with an idler wheel supported by an upper portion of the said first part; said arm and said lever being reciprocally movable in response to relative movement of said second part with respect to said first part between a closed and an open hatch or door position, elastic means being interpositioned between said second part and said lever for acting elastically between, said upper edge of said lever having a contour of, starting from at least a point of contact with said idler wheel corresponding to a totally closed position of the door, a first substnatially straight tract, a second curved tract equipped with at least one center of curvature arranged above said lever, and a third tract, also curved and equipped with at least one center of curvature arranged above said lever; said tracts together defining the upper edge of said lever free of gaps.

2. A hinge as in claim 1, wherein said third tract is connected to the said second tract by an arched projection having at least one center of curvature below said lever.

3. A hinge as in claim 1, wherein said second part includes a movable housing, further comprising a box structure for receiving insertion of the movable housing of said second part, a lower zone of the hatch or door having at least one seat for receiving said box structure therein, and fixing means for fixing the box structure to the hatch or door.

4. A hinge according to claim 3, wherein said lever is equipped, inferiorly and in proximity to a fulcrum of said lever, with an appendix projecting substantially downwards, said box structure having a housing for receiving the appendix itself when said idler wheel is in contact with said third tract, said appendix projecting into said housing for determining a substantial immovability of said second part with respect to the said box structure.

5. A hinge useful in the constraining of a hatch or door from a support structure, comprising:

first and second parts associated respectively with the hatch or door and the support structure;

an arm;

a lever with an upper edge, said upper edge having a contour with three successive tract portions;

means for pivoting the arm and said lever relative to one of said first and second parts and for reciprocally moving said arm and said lever relative the other of said first and second parts;

idler wheel means on said other of said first and second parts for guiding said lever to follow a path in which said idler wheel means contacts along the contour of said upper edge of said lever;

spring means on said one of said first and second parts for gradually and continuously descending the hatch or door during an opening phase in which said idler wheel means is in contact with said first tract portion of said upper edge of said lever and thereby ensuring that a moment exerted by said spring means on the hatch or door is less than that exerted on the hatch or door by a weight of the door with associated parts, and for overpositioning said idler wheel on said second tract portion of said upper edge of said lever which takes place when the hatch or door reaches a maximal desired open position; and arched projection means at said third tract portion of said upper edge of said lever for stopping the idler wheel means and thereby preventing the hatch or door from opening further beyond the maximal desired open position in response to further manual movement, said arched projection responding to an excessive load bearing upon the hatch or door that is beyond a predetermined maximal weight intended for the hatch or door to stay in the maximal desired open position by overcoming a resistance of said spring means and crossing said idler wheel means so as to consequently allow the hatch or door to open further immediately and eliminate any tilting moment acting on the support structure.

* * * * *